US009386835B2

(12) United States Patent
Kurokawa

(10) Patent No.: US 9,386,835 B2
(45) Date of Patent: Jul. 12, 2016

(54) FINGERTIP CARE SPONGE AND FINGERTIP CARE INSTRUMENT

(76) Inventor: Sumie Kurokawa, Hofu (JP)

( * ) Notice: Subject to any disclaimer, the term of this patent is extended or adjusted under 35 U.S.C. 154(b) by 179 days.

(21) Appl. No.: 14/125,372

(22) PCT Filed: Jun. 14, 2012

(86) PCT No.: PCT/JP2012/065287
§ 371 (c)(1),
(2), (4) Date: Apr. 29, 2014

(87) PCT Pub. No.: WO2012/173208
PCT Pub. Date: Dec. 20, 2012

(65) Prior Publication Data

US 2014/0310905 A1 Oct. 23, 2014

(30) Foreign Application Priority Data

Jun. 15, 2011 (JP) ..... 2011-133299

(51) Int. Cl.

| | |
|---|---|
| ***A45D 29/12*** | (2006.01) |
| ***A47K 7/02*** | (2006.01) |
| ***A47L 13/17*** | (2006.01) |
| ***A45D 29/00*** | (2006.01) |
| *A45D 29/04* | (2006.01) |
| *A45D 29/06* | (2006.01) |

(52) U.S. Cl.
CPC ..... *A45D 29/12* (2013.01); *A45D 29/007* (2013.01); *A47K 7/026* (2013.01); *A47L 13/17* (2013.01); *A45D 29/04* (2013.01); *A45D 29/06* (2013.01)

(58) Field of Classification Search
CPC ..... A45D 29/12; A45D 29/007; A47K 7/026; A47L 13/16; A47L 13/17
See application file for complete search history.

(56) References Cited

U.S. PATENT DOCUMENTS

| | | | | | |
|---|---|---|---|---|---|
| 2,841,811 | A | * | 7/1958 | Carroll | A47K 7/02 118/270 |
| 3,317,944 | A | * | 5/1967 | Napier | A46B 11/001 15/223 |
| 3,694,845 | A | * | 10/1972 | Engelsher | A47K 7/02 15/223 |
| D271,817 | S | * | 12/1983 | Collin | D32/40 |
| 4,466,452 | A | | 8/1984 | Ferrari | |
| 4,530,726 | A | * | 7/1985 | Montiel | A45D 29/007 132/73.5 |
| 4,866,806 | A | * | 9/1989 | Bedford | A61B 19/36 15/104.94 |
| 5,613,506 | A | | 3/1997 | Kurokawa | |
| D396,907 | S | * | 8/1998 | Donnelly | 401/289 |
| 5,823,203 | A | | 10/1998 | Carroll | |
| D429,849 | S | * | 8/2000 | Chen | D28/63 |
| D562,935 | S | * | 2/2008 | Morgan | D22/199 |
| D568,566 | S | * | 5/2008 | Gabbour | D32/40 |
| 2002/0092112 | A1 | * | 7/2002 | Large | B60S 3/045 15/244.1 |

FOREIGN PATENT DOCUMENTS

| | | |
|---|---|---|
| EP | 0710455 | 5/1996 |
| JP | S58104101 | 7/1983 |
| JP | H0521804 | 3/1993 |

* cited by examiner

*Primary Examiner* — Randall Chin
(74) *Attorney, Agent, or Firm* — Thomas A. O'Rourke; Bodner & O'Rourke, LLP

(57) ABSTRACT

The present invention discloses a fingernail/toenail care sponge for caring for fingernails/toenails that is aesthetically pleasing and that can perform quickly and correctly through simple operations.

22 Claims, 10 Drawing Sheets

FINGERTIP CARE SPONGE AND FINGERTIP CARE INSTRUMENT

FIELD OF THE INVENTION

This invention relates to using a fingertip care sponge and a fingertip care device utilizing the fingertip care sponge to treat fingernails.

BACKGROUND OF THE INVENTION

Traditional implements for buffing the surface of fingernails are generally understood to have a file anchored to the surface of a lever for users to adjust the filing surface of the lever and the contact angle properly to the surface of the fingernail while buffing the fingernail surface. However, the fingernail surface is normally curved, making it difficult to polish the surface of the curved fingernail completely with files that have a flat surface. Toenails, in particular, have even more of a curvature than fingernails, making them especially difficult. In light of these circumstances, an invention of an implement for caring for the fingernail surface is being disclosed.

Unexamined Japanese Patent Application Publication No. 2004-8427 (hereinafter "Patent Literature 1") discloses a nail enamel remover for fingernails and toenails that makes contact and friction only on the part of the fingernail and toenail. The nail enamel remover has an enamel coating with a fan-shaped curved surface.

In the present application, a sponge body is housed in a hollow cylindrical container wherein one (1) end of the sponge body with nail enamel remover infused within the sponge body is press-reversed inside the hollowed out part. This embodiment is disclosed in FIGS. 9 through 11 of Patent Literature 1. A fingertip can be inserted into the end opening where the sponge body in the cylinder is folded into, then the fingertip is rotated on the center axis of the sponge body to remove the nail enamel cleanly through the action of the remover infused in the sponge body and through the contact action with the inner circumference of the hollowed out part of the liquid sponge body and the nail surface due to the sponge body with the structure described earlier.

The structure of the nail enamel remover disclosed in Patent Literature 1 described earlier is somewhat restricted according to the thickness of the finger to be inserted into the finger protection sheath when, for example, it is used as a nail polisher, making it necessary to have a finger protection sheath according to the thickness of the finger to be treated, reducing the versatility of the implement where the user must have any number of implements ready to match the thickness of the finger to be treated. Versatility is reduced particularly for the invention disclosed in Patent Literature 1 as sizes appropriate for fingers cannot be used for toe care. Further, the sponge disclosed in Patent Literature 1 merely press-reverses one end of a thick cylinder with a simple shape as disclosed in FIGS. 9 through 11 in Patent Literature 1. Simply put, sponges with a larger diameter than that of the hollowed-out part are pressed into the hollowed-out part of the sponge, making for a non-uniform sponge compression rate on the portion where the sponge is folded and press-fitted, while the roughness of the sponge compressed into the hollowed-out part is irregular and not eye-catching. This makes providing a high aesthetic beauty aid difficult as it is used but stripped of the press-reversed part of the sponge. The sponge of Patent Literature 1 also exerts strong pressure felt on the fingertips when they are inserted into the press-reversed part of the sponge, while having a dissimilar and non-uniform repulsive force of the sponge acting on the fingertips. This makes it difficult to have a pleasant sensation on the fingertips when the sponge is rotated on its center axis. The roughness that can be press-reversed on the sponge in particular is not intentionally shaped with a regular pattern when the sponge disclosed in Patent Literature 1 is used in a nail enamel remover, but creates inadvertent roughness, thus its valleys (grooves) have especially poor shape retention. This is because the groove has a concave shape formed unintentionally by a large compressive force created on the sponge, thus the sponge has a particularly strong repulsive force at the grooves, a force that acts to eliminate the concave shape. The force retaining the "lam'" and "stone" used for nail enamel decoration is also particularly weak at these grooves due to the reasons described earlier which caused the problems of easily reapplying the lame' and stone when removing nail enamel with a nail enamel remover using the sponge disclosed in Patent Literature 1.

The purpose of the present invention in addressing the foregoing need in the art is to provide a sponge for fingertip care with a pleasant sensation by making the appearance of the folded part, when the sponge body in a thick cylinder is press-reversed in this hollowed-out part beautiful, form regular roughness on the press-reversed sponge body in the hollowed-out part and create friction on the fingertip surface using a homogenous force on the protruding part when they are inserted into this press-reversed part. The present invention will also provide a highly versatile fingertip care implement with a simple structure using this fingertip care sponge.

SUMMARY OF THE INVENTION

The fingertip cure instrument consists as described in a first embodiment of a sponge body for a cylinder wherein the sponge comprises a hollowed-out part formed though the axial direction of the sponge and wherein the sponge comprises protrusions formed into a gear-shape in the vertical cross section in the axial direction on the outer periphery of the sponge. The sponge body further comprises a folded part where at least a portion of the outer periphery is folded into the hollowed-out part that receives the fingertip of a person. Once the fingertip is inserted into the hollowed out part with at least a portion of the folded part folded into the hollowed out part, the sponge body is rotated on its center axis while the fingertip is rotated on the center axis of the sponge body. Both of these rotation actions are performed simultaneously to create friction on the nail surface at the protrusions projecting from the hollowed-out part. The invention of the structure described earlier is of a protrusion projecting and forming a radial shape towards the outer periphery side of the sponge body from the center of the vertical cross section in the axial direction of the sponge body; i.e., it has a protrusion forming a gear-shape in the vertical cross section of this sponge body, thus having the effect of regularizing a rough shape compressed and formed in the hollowed-out part when at least a portion of the outer periphery of this sponge body is pressed into the hollowed-out part. The present invention has the effect of making the compression rate in the vertical cross section in the axial direction of the sponge body pressed into the hollowed-out part uniform. The effect of the present invention also makes the elastic rebound force which acts on the fingertips from these protrusions formed towards the center axis of the sponge body uniform in the hollowed-out part of the body when the fingertip is inserted into the hollowed-out part from the folded part of the sponge body. This effect further creates friction in the direction where the nail surface intersects in the nail extending direction and provides a pleasant sensation on the fingertips when the sponge body is rotated on its center axis, when the fingertip is rotated on the center axis of the sponge body, and when both actions are performed simultaneously while the fingertip is inserted into the hollowed-out part from the folded part of the sponge body due to the protrusions projecting towards the center axis of the hollowed-out part.

A second embodiment of the fingertip care implement features the fingertip care sponge described above with respect to the first embodiment and a container body while the folded part of this fingertip care sponge is inserted through the end of the container body that comprises an aperture. Further, the opening for inserting a finger into the finger care sponge faces outwardly from the container body on the aperture side of the container body. The container body includes projections to the interior portion of the container body that are adapted to mate with the grooves formed on the exterior surface of the fingertip care sponge. The fingertip care sponge mated with the interior portion protrusions of the container body prevent slippage of the fingertip care sponge in the container body when the container body is rotated with the fingertip care sponge therein to polish the nail enamel of a user. The container body also has the effect of stripping and housing at least of portion of the folded part of the sponge body from the aperture with the folded part of the fingertip care sponge positioned on the aperture side. The smooth stopping parts projected to the inner periphery of the container body also mate with the grooves formed on the outer periphery of the fingertip care sponge to retain the fingertip care sponge when the fingertip care sponge is housed in the container body and the container body is rotated to polish fingernail enamel. The mating has the effect of rotating the fingertip care sponge on its center axis where it is housed in the container body when the container body is rotated on its center axis.

A third embodiment of the fingertip care implement has the fingertip care implement features described above in the second embodiment, where the height from the inner periphery of the container body has smooth stopping parts that are raised towards the bottom of the container body. The structure has the same effect as described above, while also raising the pressing force on the sponge body according to the smooth stopping parts towards the bottom of the container body, thus having the effect of compressing the sponge body located at the bottom of the container body more strongly.

Another fourth embodiment of the fingertip care implement is as described above for the second and third embodiments, with the addition that it features a container with a finger locking ring at the aperture for inserting a finger into the finger care sponge. The finger locking ring retains the fingertips in the aperture of the container body when performing care on the fingertip. It makes inserting the fingertip into the hollowed-out part of the fingertip care sponge housed in the container body smooth. As to how to attach the finger locking ring in the container body, it is installed integrally with the container body in the aperture of the container body, for example, by allowing it to be installed so that it rotates with the container body and also be installed to rotate independent of the container body. The finger locking ring may also be installed in the aperture of the container body to allow for its removal. The finger locking ring has the particular effect of allowing the diameter of the container body aperture to be change to the desired size by adjusting the finger locking ring in this instance.

A fifth embodiment of the fingertip care implement is as described above for the fourth embodiment, while also featuring the finger locking ring equipped with a shielding material that consists of a flexible material positioned to cover the hollowed-out part, wherein the shielding material is equipped with a slit, cut or a combination of both to fold it so as to restore this part to the hollowed-out part side of the container body. This embodiment of the invention also works to apply both a physical and chemical polishing process wherein the chemical may be liquid, powder, cream or paste polishing solvent, nail enamel removal liquid, gel nail removal solvent, etc. being infused into the fingertip care sponge in addition to the direct friction action caused by the rotating fingertip care sponge onto the nails. More specifically, the friction on the nail surface caused by the protrusions on the sponge body, combined with the effect of liquid, powder, cream or paste polishing solvent infused into the sponge body works to polish the nail surface smoothly. The effect of friction on the nail surface from the sponge body, and the nail enamel removal liquid infused in the sponge body also works to dissolve the nail enamel painted on the nails while buffing and removing. Further, the combination of this effect and the lame' & stone decorating the nail enamel results in a clean removal of the finish. When gel nail removal solvent is infused to the fingertip care sponge, for example, it minimizes contact between the gel nail removal solvent and skin on the fingertip while efficiently supplying gel nail removal solvent on the nail surface. In addition, the shielding material plays a barrier-type role, and works to prevent additives (liquid, powder, cream, paste, etc.) infused into the fingertip care sponge from leaking from the container aperture when the container is tilted to insert the fingertip into the hollowed-out part of the container. The shielding material also works to block vaporization as the additives infused into the fingertip care sponge are volatile.

Further, adding shielding material covers the container aperture, working to block dirt adhering to the fingertip care sponge housed in the container, for example, the removed nail enamel, a decorative feature such as lame', stones, etc. from getting rubbed into the user's eyes The shielding consist or flexible materials, thereby allowing some of the shielding material to be folded so that it can be returned into the inside of the container, providing a soft sensation of the shielding material felt by the fingertip while reducing discomfort during care, even when the shielding material is rotated along with the container resulting in friction during care. The shielding material can also be integrated into the finger locking ring, another ring can be installed which rotates independently from the first finger locking ring to the inside of the finger locking ring, and may be integrated into this ring body. Simply put, the shielding material can be installed either directly or indirectly to the finger locking ring.

Another ring positioned inside of the finger locking ring is positioned where the fingertip being treated along with the shielding material is resting, working to block additives infused onto the fingertip care sponge from coming in contact with skin other than that of the fingertip nail being treated as the shielding material adheres to the fingertip surface when the container is rotated on its center axis particularly in the latter case. Further, the shielding material is formed with a slit, cut or a combination of the two that works to enable some of the shielding material to be folded so that it can return into the hollowed-out part of the container when the fingertip is inserted into this hollowed-out part, A sixth embodiment of the fingertip care implement is as described for any of the above described embodiments, with it additionally including a rotating ring that rotates on the center axis of the container. The rotating ring installed circumferentially on the outer periphery of the container in this embodiment particularly works to rotate the rotating ring or container on the center axis of the container while the container or rotating ring is resting at the desired position.

Based on the invention described above for the first embodiment, the sponge body protrusions can be fitted without any gaps to the surface of the nail where a curve is formed using the repellent force of the compressed sponge body, when the fingertip is inserted into the hollowed-out part from the folded part of the sponge body.

Friction is thereby created so that the surface of the fingertip can be wiped by the protrusions projecting into the hollowed-out part as the sponge body is rotated on its center axis, or the fingertip is rotated on the center axis of the sponge body, or a combination of both simultaneously, providing a pleasant sensation on the fingertip. This allows for easy and comfortable care of the entire fingertip and nail surface with a curved shape through simple operations.

The sponge body described in the first embodiment, in particular, consists of materials for polishing the surface of the nails, while the nail surface with a curved shape can be polished fully and evenly through simple operations whereby the finger or sponge body is rotated on the center axis of the sponge body, wherein the sponge body is infused with a liquid, powder, cream or paste polishing solvent. The user can treat their nails easily without having to pay any special attention because the condition of the nail surface to be polished does not have to be visually confirmed each time. More specifically, nails can be treated comfortably during odd jobs, while watching television, etc. Nail enamel can also be removed quickly from all nail surfaces shaped in a curve through simple operations whereby the finger or sponge body is rotated on the center axis of the sponge body while removal liquid to remove nail enamel is infused into the sponge body described in the first embodiment. Re-adhesion of lame' and stones when removing nail enamel can be presented as the lame' and stones used for nail enamel decoration removed from the nails is retained in the valleys (grooves) of the protrusions projecting inside the hollowed-out part when removal liquid is infused in the sponge body and used to remove the nail enamel. This allows nail enamel and their decorations to be removed quickly and correctly. This work can also be done easily without having to pay too much attention, similar to polishing nails. More specifically, nails can be treated comfortably during odd jobs, while watching television, etc. It has the effect of being able to apply highly effective gel nail removal solvent only to the fingertip to have gel nail applied when the gel nail removal solvent is infused in the sponge body. The fingertip skin and nail care implement of the present invention, which also massages the fingertip, can be performed by the protrusions projecting inside of the hollowed-out part through the operation of the finger or sponge body being rotated on the center axis of the sponge body when moisturizer for hand care is infused to the sponge body. This work can be performed comfortably during odd jobs while doing something else without having to pay any special attention.

In addition, the appearance of the folded part of the sponge body when viewed from above looks as if flower petals were carved out in 3D (chrysanthemum crest-like appearance), giving the fingertip care sponge body a sensuousness. Thus, it offers sensuousness and design to beauty equipment when the fingertip care sponge is used as a part of beauty aid tools.

The invention described for the second embodiment has the effect of the fingertip care sponge described in the first embodiment and works to rotate the fingertip care sponge indirectly using the container body. This allows for better care and convenience when used with liquid, cream or other medicine needed for nail or fingertip care infused to the fingertip care sponge as required. Simply put, the user can operate it without indirectly touching the fingertip care sponge infused with medicine, liquid, cream, etc. needed for nail or fingertip care.

The folded part of the sponge body denuded from the container body aperture also has the improved fingertip care implement sensuousness of the second embodiment as it has a 3D and regular shape making it look like a flower (chrysanthemum crest-like appearance). Thus the invention of the second embodiment provides a beauty aid tool with superb functionality and design.

The invention of the third embodiment has the same effect as the invention of the second embodiment, and can also improve the compression rate of the fingertip care sponge housed near the bottom of the container by improving the shape of the anti-slip materials projecting into the hollowed-out part towards the bottom of the container. This also improves the retention force of the liquid on the bottom side of the container. It can firmly retain liquids in the sponge body on the bottom side of the container in particular through the suction force accompanying restoring the compressed sponge because the compression rate of the sponge body improves the closer to the bottom of the container it approaches in this instance. This results in making it more difficult for liquids to leak from the container even when the container aperture is tilted to the vertically downward side when used with liquid infused to the sponge body housed in the container as required. The invention described in the third embodiment can reduce the chance of dripping even when used with liquid infused to the fingertip care sponge. Thus it can be used with the fingertip care sponge tilted freely by the user to the desired angle housed in the container.

The invention described in the fourth embodiment has the same effect as the invention described in the second and third embodiments, and can have the diameter of the aperture set to the desired size appropriate for the size of the fingertip to be treated using the finger locking ring installed to the container aperture. Thus the proper position and angle of the hollowed-out part of the fingertip care sponge inside the container can be maintained so that the fingertip to be treated can be inserted by engaging the finger to be treated in the finger locking ring. The invention of the fourth embodiment thereby provides more efficient care of the fingertip with the fingertip care sponge. Nail enamel up to where the nail meets the skin in particular can be removed correctly as the proper position and angle of the fingertip to be treated are maintained and retained in the finger locking ring. Nail enamel removal liquid is infused to the fingertip care sponge in the fourth embodiment and used for nail enamel removal.

The invention described in the fifth embodiment has the same effect as the invention in the fourth embodiment, and can also prevent additives infused into the fingertip care sponge from leaking when the container is tilted to treat the fingertip because the finger locking ring is equipped with shielding materials. The volatility of additives infused to the fingertip care sponge can also be controlled because it is equipped with shielding materials. Further, dirt on the fingertip care sponge never touches the user's eyes because of the masking role the shielding materials have on the fingertip care sponge when there is a lot of dirt adhering to the sponge housed in the container, thus making fingertip care with the fingertip care sponge more relaxing. Even further, fingertips can be inserted into the container as some of the shielding folded into the container can be restored because a slit, cut or a combination of both are formed to the shielding materials. The skin on the back of the hands (mainly the nails) can also be treated with the fingertip care sponge and the additives while masking and protecting the skin on the ventral side of the finger which does not have to come in contact with additives infused to the fingertip care sponge, when the shielding materials are installed separately on the inner side of the finger locking ring and another ring which rotates independently of the finger locking ring is installed. This allows the harmful effects of solvents or polishing solvent on the skin on the ventral side of the finger that needs no care to be greatly reduced even when they are used in strong concentrations to stimulate the skin. Thus the invention described in the fifth embodiment can provide a fingertip care implement with better functionality.

The invention described in the sixth embodiment has the same effect as the invention described in the second thru fifth embodiments, respectively, and further allows for the container positioned on its inner side to be rotated while the rotating ring equipped on the outer periphery of the container is resting. The outer periphery means there is no direct contact as the other fingers not being treated are contacting the rotating ring. This greatly reduces the discomfort of the fingers not being treated when caring for the desired finger, the other fingers not being treated not being rubbed against the container when the fingertip care sponge is rotating for each container body. Thus it can provide a fingertip care implement with better comfort and quality of usability.

DESCRIPTION OF SYMBOLS

Figure 1B:
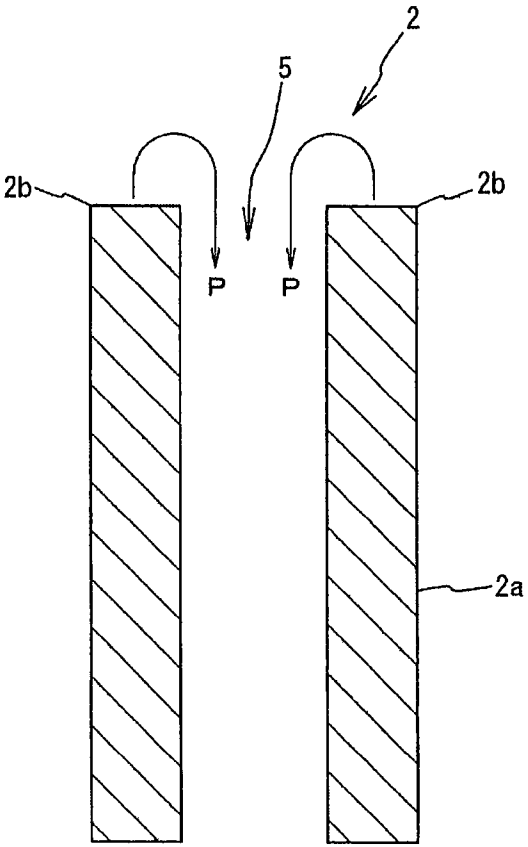
FIG. 1*b* is a sectional view drawing along the line A-A in FIG. 1*a*.

1 . . . Fingertip care sponge
2 . . . Sponge body
2*a* . . . Outer periphery
2*b* . . . Edge
3 . . . Protrusion
4 . . . Groove
5 . . . Hollowed-out part
5*a* . . . Inner periphery
6 . . . Folded part
7*a*-7*c* . . . Container
8*a*-8*c* . . . Finger locking ring
9 . . . Mating
10 . . . Return
11 . . . Aperture
12 . . . Aperture
13 . . . Toes (except big toe)
14 . . . Nail
15*a*-15*c* . . . Cap
16 . . . Anchoring material
17 . . . Aperture
18 . . . Aperture
19 . . . Mating
20 . . . Finger receptacle
21 . . . Toes (big toe)
22 . . . Nail
23*a*-23*c* . . . Fingertip care implement
24 . . . Anti-slip materials
25 . . . Cap body
25*a* . . . Threaded part
26 . . . Shielding
27 . . . Outer container
27*a* . . . Threaded part
28 . . . Shielding
28*a* . . . Folded piece
29 . . . Slit
30 . . . Mating
31 . . . Rotating ring
32 . . . Aperture
33 . . . Foot
34 . . . Toe
35 . . . Nail
36 . . . Ridge

DETAILED DESCRIPTION OF THE INVENTION

First Embodiment of the Invention

Figure 1A:
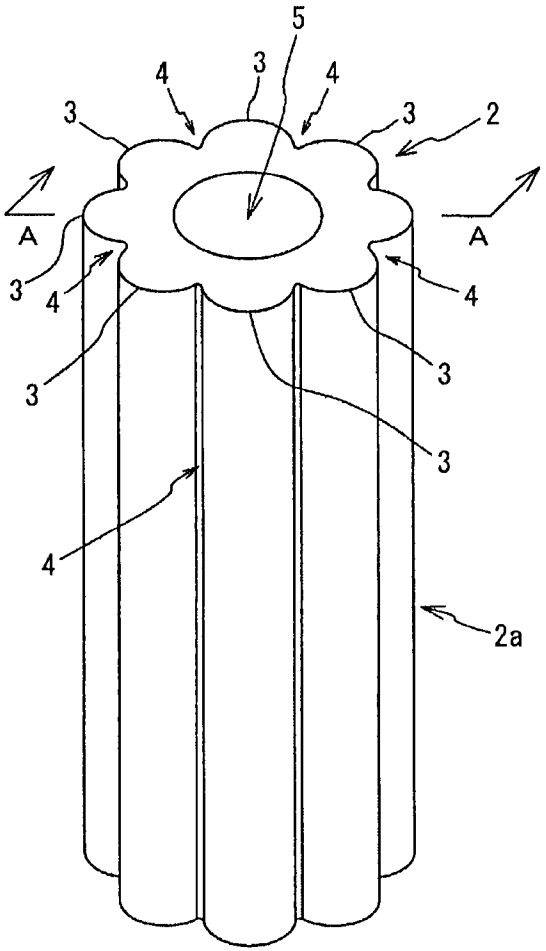
FIG. 1*a* is a view of the outline of a first embodiment showing the outline of the sponge body consisting of the fingertip care sponge of a first embodiment of the invention.

First, see FIGS. 1*a*, 1*b*, and 2 for details on the fingertip care sponge of the first embodiment of the present invention. FIG. 1*a* is a view of the first embodiment of the invention that shows the external shape of the sponge body consisting of the fingertip care sponge. FIG. 1*b* is a sectional view drawing of the line A-A in FIG. 1*a*. FIG. 1*a* shows a plurality of protrusions on the outer periphery 2*a* of the thick cylindrical sponge with the hollowed-out part 5 formed through the axial direction of the sponge body. The protrusions of the fingertip care sponge in this embodiment project radially extending in the axial direction of sponge body 2. Also, the gap between the protrusions 3 in the sponge body 2 are grooves 4. The fingertip care sponge 1 of the first embodiment of the invention is where the whole circumference of the edge 2*b* of the sponge body 2 is shown in FIG. 1*a* with the cross sectional view of the sponge body shown in FIG. 1*b*. FIG. 1*b* shows that the whole circumference of edge 2*b* of sponge body 2 before it is pressed into the direction shown in symbol P in Drawing 1(*b*) to create the structure shown in FIG. 2(*a*), which shows the sponge body 2 being inverted inside-out and folded inside hollowed-out part 5.

Figure 2C:
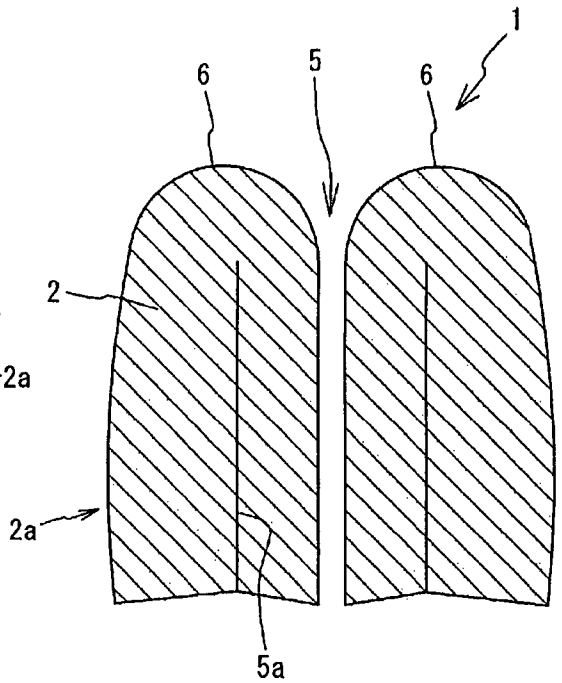
FIG. 2*c* is a sectional view drawing of line B-B in FIG. 2*a*.
Figure 2B:
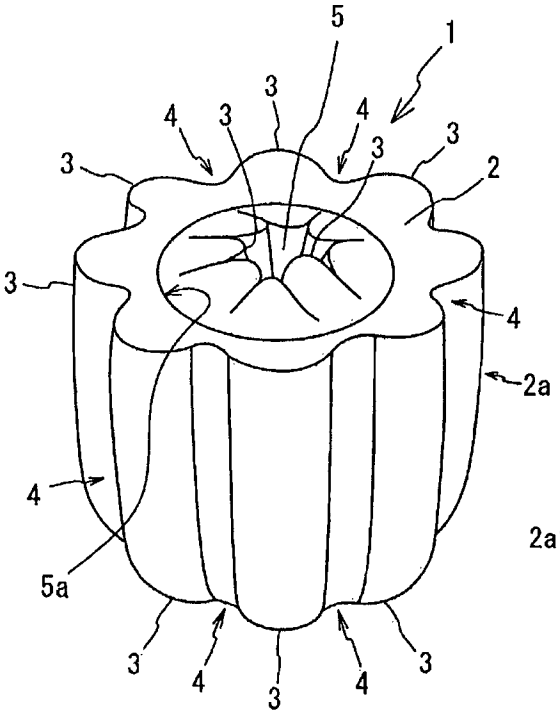
FIG. 2*b* is a conceptual drawing viewed from the bottom side of the fingertip care sponge of the first embodiment of the invention.
Figure 2A:
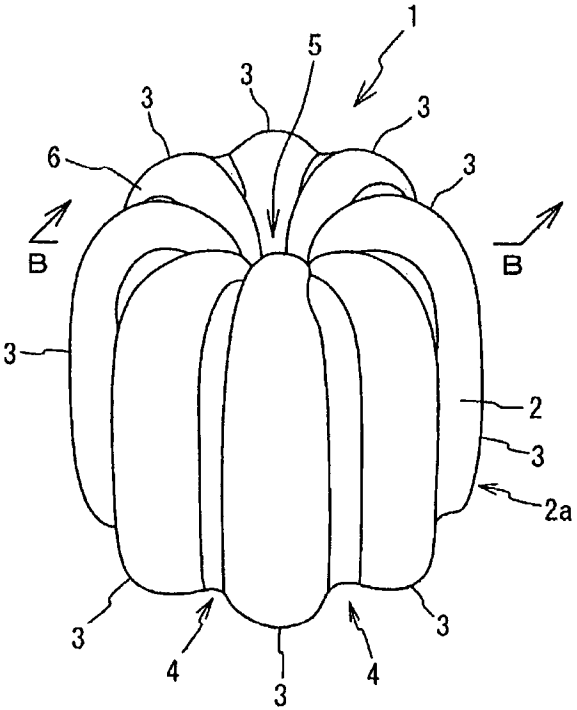
FIG. 2*a* is a conceptual drawing viewed from the top side of the fingertip care sponge of the first embodiment of the invention.

FIG. 2*a* is a top perspective view of the fingertip care sponge of FIG. 1 where one end of the sponge has been pushed into the opening 5, while FIG. 2*b* is a bottom perspective view of the sponge of FIG. 2*a*, and FIG. 2*c* is a section view taken along the line B-B in FIG. 2*a*. Also, the same parts as described in FIG. 1*a*-1*b* have the same symbols, and a description of its structure is omitted. As shown in FIG. 2*c*, part of the sponge body 2 is folded into the hollowed-out opening 5. Thereafter, a portion of the protrusions formed in the outer periphery 2*a* of sponge body 2 are directed towards the hollowed-out opening i.e., towards the center axis. The sponge 2 which is folded into the hollowed-out part 5 is compressed, thus the protrusions 3 positioned into hollowed-out part 5 press the surface of the finger due to the repulsive force of the compressed sponge 2 when a fingertip is inserted from folded part 6 of fingertip care sponge 1 into the hollowed-out part 5. Simply put, the protrusions 3 positioned into the hollowed-out part 5 extend closely toward the fingertip.

Figure 9:
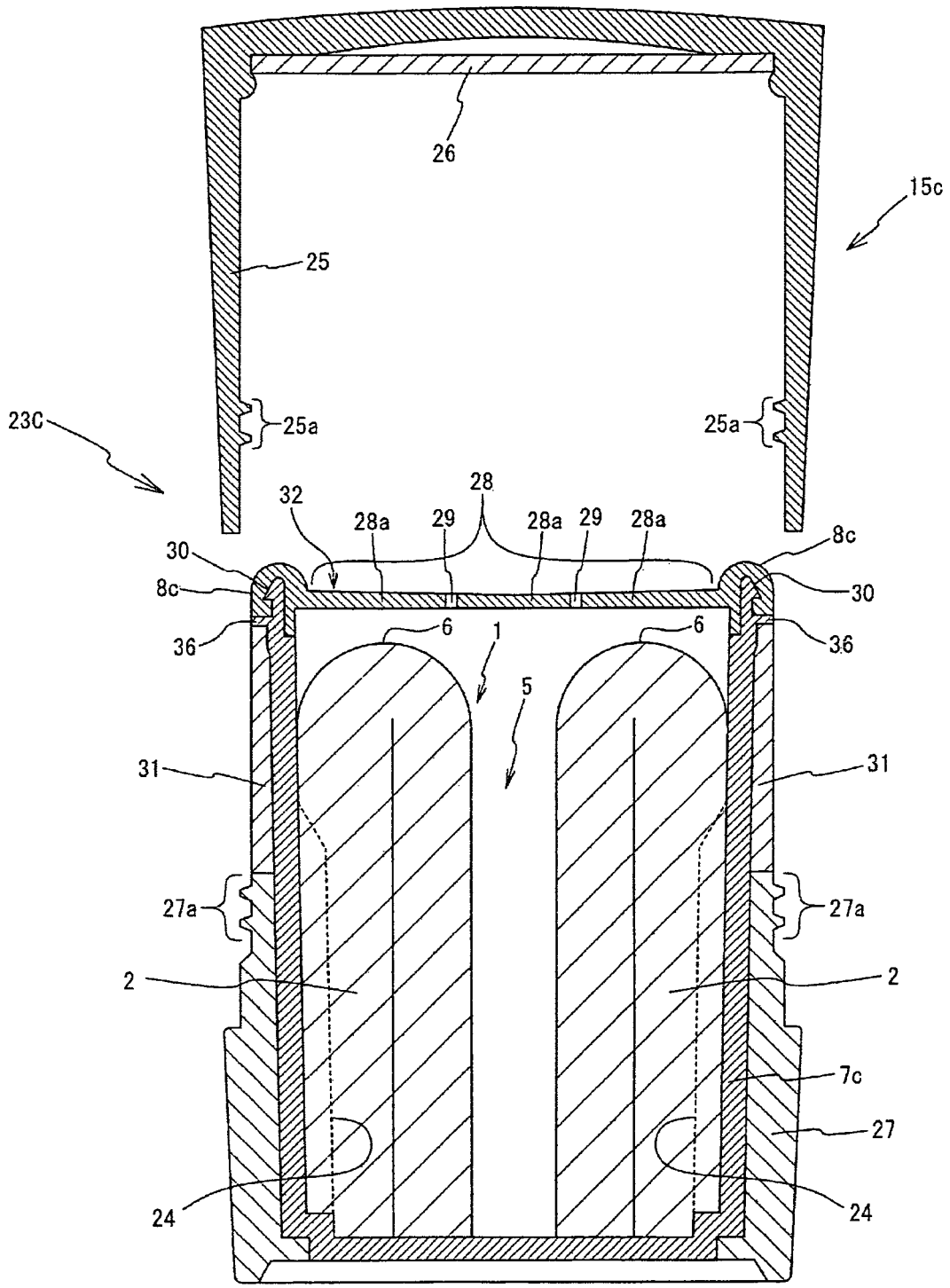
FIG. 9 is a cross-sectional view of the fingertip care implement of a fourth embodiment of the present invention.
Figure 10:
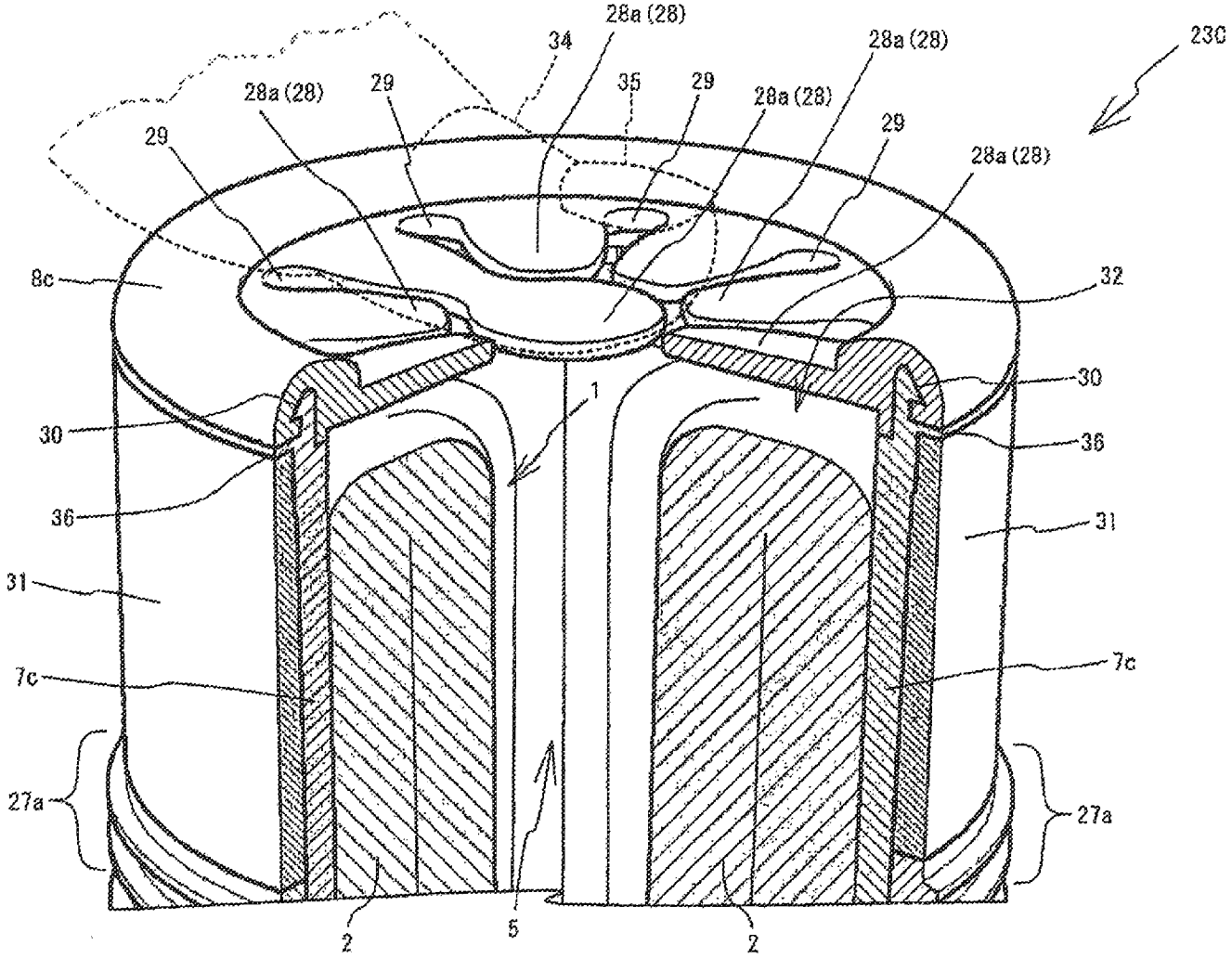
FIG. 10 is a perspective view of the top portion of the fingertip care implement of FIG. 9.
Figure 11:
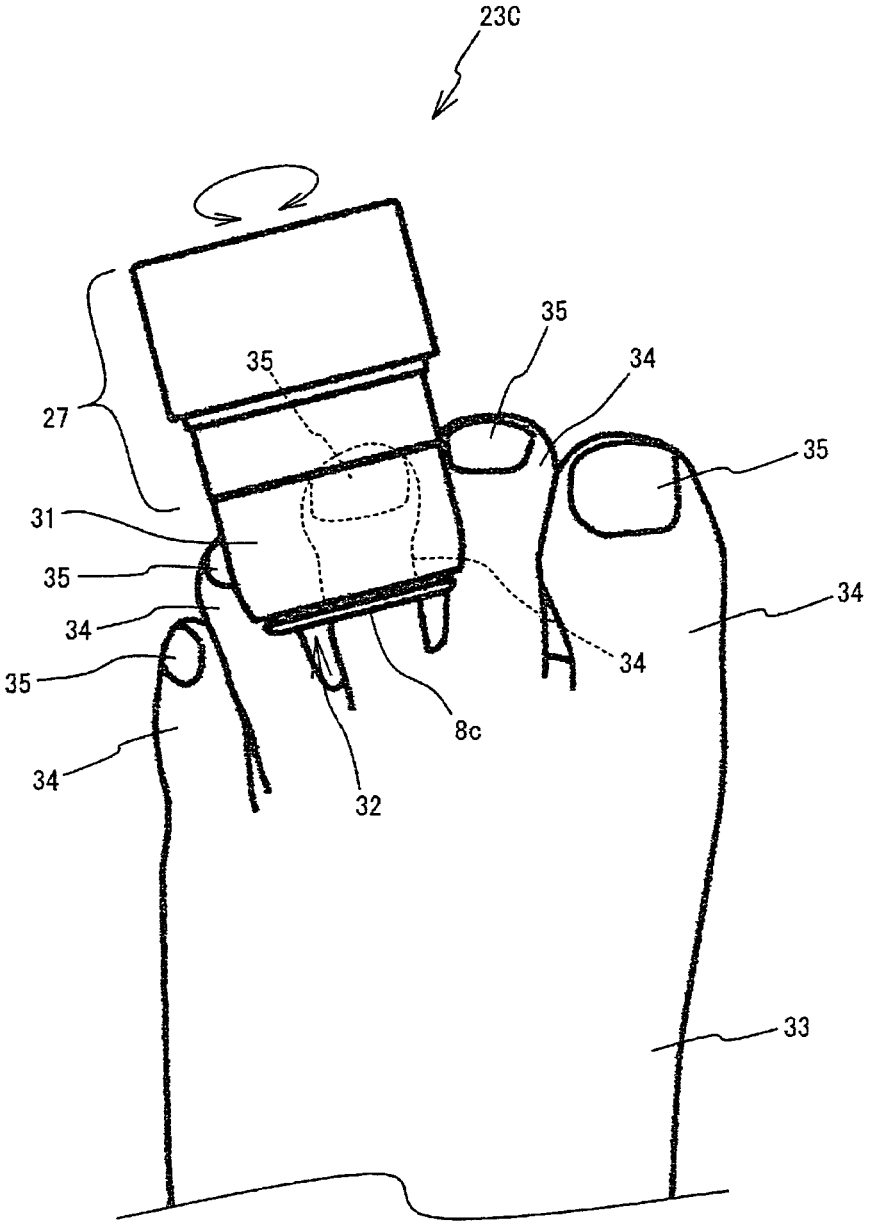
FIG. 11 is a top view of the fingertip care implement of FIG. 9 that is secured to the toe of a user.

The fingertip care sponge 1 of the first embodiment of the intention is also different to the sponge body shown in FIGS. 9 to 11 of Patent Literature 1. In particular, the protrusions 3 and grooves 4 are formed systematically to the outer periphery 2*a* of the sponge body 2 and thus the protrusions 3 and grooves 4 are formed systematically in the hollowed-out part 5 when part of sponge body 2 is folded into the hollowed-out part 5. Simply put, the fingertip care sponge 1 has protrusions 3 and grooves 4 formed systematically and in a radial shape to the outer periphery 2*a* of fingertip care sponge 1 and the hollowed-out part 5. Further, the portion of the sponge body 2 in the hollowed-out part 5 has a higher compression rate than the outer periphery 2*a* side of fingertip care sponge 1. The fingertip care sponge 1 also preferably has a uniform compression rate for each protrusion 3 and groove 4 of the sponge body 2 housed in the hollowed-out part in the circumferential direction of the vertical cross-section for the center axis of fingertip care sponge 1. Thus, the repulsive force acting on the finger from each protrusion 3 located in hollowed-out part 5 is uniform when a finger is inserted from the folded part 6 of fingertip care sponge 1 into the hollowed-out part 5. The uneven form of outer periphery 2*a* of the sponge body 2 prevents a particularly high compression rate of the sponge body 2 located near the center axis of the sponge body 2 when the sponge body 2 is press fit into the hollowed-out part 5. This results in reduced clamping and pressure when a fingertip is inserted into the hollowed-out part 5 of the fingertip care sponge 1, thereby creating a pleasant feeling.

The fingertip care sponge 1 described earlier herein has a finger or toe inserted from the folded part 6 of the sponge body 2 and either the sponge body 2 is rotated on its center axis, the tip of the finger or toe is rotated on the center axis of sponge body 2, or both of these actions may be performed simultaneously. Friction is created on the surface of the finger and nail present in the device for care due to the movement towards the circumferential direction of the finger surface while the protrusions 3 positioned in hollowed-out part 5 of the fingertip care sponge 1 are pressed against the surface of the finger at this time. The sensation of the contact and movement of the multiple protrusions 3 in the area of the fingertip at the proper pressure, as in the present invention, is pleasant for the user.

More specifically, the fingertip surface can have dirt removed and the fingertip surface massaged because of the protrusions 3 when only the sponge 2 is used wherein the sponge is porous and flexible is used. The fingertip cuticles can also be removed and nails polished by using the fingertip care sponge 1 when the sponge body 2 is used alone and wherein it consists of tough materials that rub the nails and drop the skin off. While FIG. 2*a*-*c* describes an example where eight (8) of protrusions 3 are formed on the outer periphery of fingertip care sponge 1, there is no limit to the number of protrusions that may be present, but at least 3 protrusions are desired in considering aesthetics when it has the thickness and length of the sponge 2 to be used and made into fingertip care sponge 1. While there is no particular upper limit of the number of protrusions 3, too many protrusions makes the manufacture more complex and grooves more shallow which results in diminishing the beneficial effect of the present invention, thus this must be considered in the decision to include more protrusions and grooves.

The sponge body 2 of the fingertip care sponge of the first embodiment of the present invention also consists of a porous, flexible sponge body 2, and as described earlier herein, can remove nail enamel easily by infusing the sponge body with nail enamel removal liquid. The Grooves 4 are also formed for each angle in the circumferential direction in the hollowed-out parts 5 of the fingertip care sponge 1 and can suitably maintain lame' and stone in the grooves 4 even when they are used for nail enamel decoration. Thus it prevents re-adhesion of lame' and stone when removing mail enamel. Thus, the formed position of grooves (valleys) formed on the sponge body folded in the hollowed-out part are incidental to the use of part of the simple cylindrical sponge revealed in Patent Literature 1 where they are press-inverted into the hollowed-out part, instead of the fingertip care sponge 1, and has a stronger effect in widening and eliminating the grooves than maintaining the groove shape as the sponge body is compressed strongly where these grooves are formed. Thus it works to extrude the lame' and stone maintained here when the fingertip touches the valleys, thereby making re-adhering lame' and stone to the nails easier than when the sponge body revealed in Patent Literature 1 is used. Therefore, nail enamel using lame' and stones can be removed quickly and correctly compared to traditional techniques when removal liquid is infused into the fingertip care sponge 1 of the present invention. While not depicted per se, gel nail removal solvent can also be applied only to the fingertip area itself when this solvent is infused into fingertip care sponge 1.

The sponge body 2 of the fingertip care sponge 1 also comprises a porous, flexible sponge body 2 as described earlier herein which can polish nails when a liquid, powder, cream or paste nail polisher is infused into the sponge body 2. While not depicted, powdered or granulated nail polisher may also be applied along the ridge line of the protrusions 3 located in hollowed-out part 5 of the sponge body 2. Nails can be polished very efficiently, the amount of nail polisher can be minimized. In addition, manufacturing costs for the fingertip care sponge 1 used for nail polishing can also be reduced in this instance.

When fingertip care is performed using the fingertip care sponge 1, the user inserts a fingertip into the hollowed-out part 5 from the folded part 6 of fingertip care sponge 1 whereby the sponge body 2 is rotated on its center axis, or the tip of the finger or toe is rotated on the center axis of sponge body 2, or both are rotated simultaneously. In this way the user can directly observe the care which removes the complexity of careful implement operation, etc. in all situations. Thus fingertip care can be performed easily even while the user is doing something unrelated. Further, the present invention also provides a pleasant feeling when performing fingertip care. Simply put, the fingertip care sponge 1 of the present invention provides a beauty aid and implement that includes a pleasant feeling in use.

The appearance of the fingertip care sponge 1 also has a shape like a flower petal sculpted in 3D (ex. a chrysanthemum crest-like shape) when viewed directly on top of its folded part 6, resulting in the fingertip care sponge 1 itself having a high aesthetic and design appeal. Accordingly, the fingertip care sponge 1 provides a visually appealing, beautiful beauty aid and its parts.

Second Embodiment of the Invention

Figure 3B:
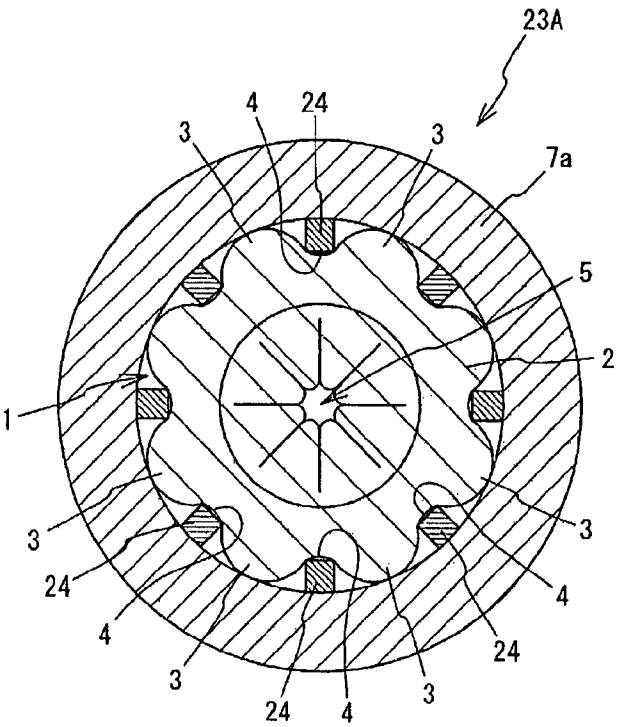
FIG. 3*b* is a sectional view drawing of the line C-C in FIG. 3*a*.
Figure 3A:
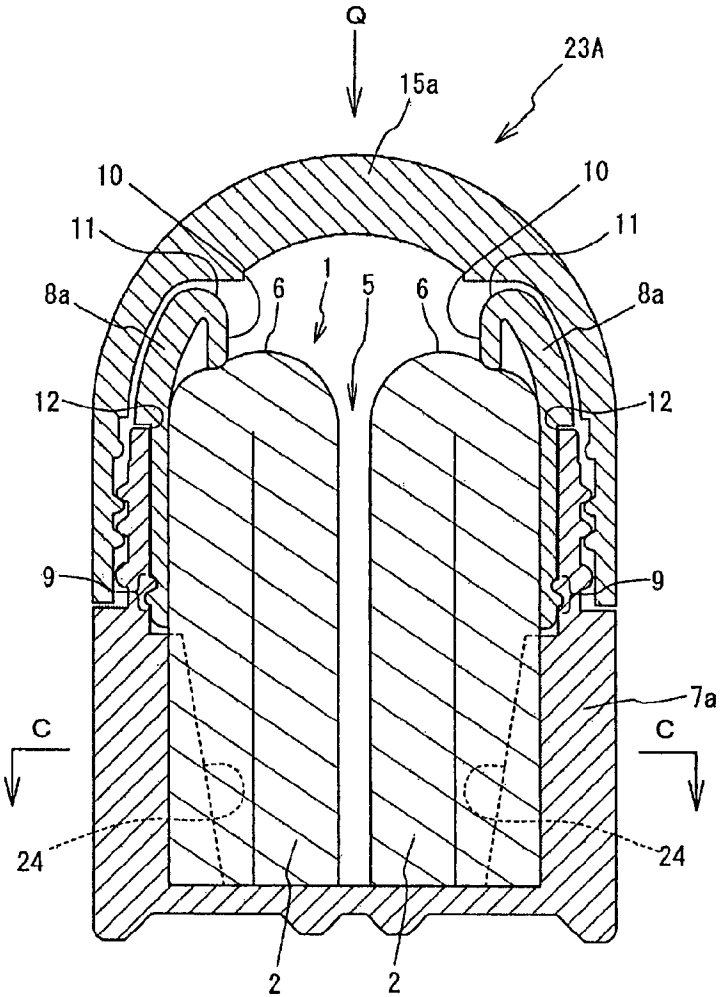
FIG. 3*a* is a cross-section of the fingertip care implement of a second embodiment of the invention.

FIGS. 3*a* to 5 show a second embodiment of the fingertip care implement of the present invention. Some of the symbols applied to FIGS. 3*a*-3*b* are also the same as those described in FIGS. 1*a*-2*c*, and the description of the symbols are omitted in the discussion of FIGS. 3*a*-5. FIG. 3*a* is a cross-sectional view of the fingertip care implement of a second embodiment of the invention. FIG. 3*b* is a sectional view taken along the line C-C in FIG. 3*a*. A general description of the fingertip care implement 23A of FIG. 3*a*-5 is where the fingertip care sponge 1 of FIGS. 1*a*-2*c*, described earlier herein, is housed in the container, and is configured to allow the fingertip care sponge 1 to be manipulated while housed in this container, as shown in FIGS. 3*a*-3*b*. More specifically, the fingertip care sponge 1 is housed in the fingertip care implement 23A of FIGS. 3*a*-5 in the hollowed-out part of the container body 7*a* with aperture 12 where its folded part 6 is positioned at the aperture side 12 of the container body 7*a*. In addition, at least two (2) anti-slip material sheets 24 are installed protruding towards the center axis of container body 7*a* while stretched in the center axis direction of the container body 7*a* on the inner periphery of the container body 7*a*. The anti-slip material is configured to mate to the grooves 4 of the fingertip care sponge 1 (See FIG. 3*b*). The fingertip care sponge 1 is also co-rotated on the center axis towards the container body 7*a* by rotating the container body 7*a* on its center axis while the fingertip is inserted into hollowed-out part 5 of fingertip care sponge 1 from the aperture 12 of the container body 7*a* when fingertip care sponge 1 is housed in container body 7*a* with anti-slip material 24. Basically, the fingertip care sponge 1 can be manipulated indirectly while housed in the container body 7*a* by integrating the anti-slip material 24 with the fingertip care implement 23A of FIGS. 3*a*-5.

Applied liquid, cream, etc. can be prevented from getting on the hand not being treated when liquid, cream; i.e., nail enamel removal liquid, gel nail removal solvent, liquid, powder, cream or paste nail polisher, fingertip care cream and so forth for fingertip care applied to fingertip care sponge 1 are infused into the sponge body 1. At least two (2) anti-slip material 24 sheets that project into the inner periphery of container body 7*a* are also required, and only the same number as the number of grooves 4 formed to the circumference of the fingertip care sponge 1 is needed, the anti-slip material 24 must also be placed in the position where they coincide with grooves 4 of the fingertip care sponge 1 housed in the container body 7*a* (See FIG. 3*b*).

The finger locking ring 8*a* that rotates on the center axis of container body 7*a* may also be mated to aperture 12 of container body 7*a* as shown in FIG. 3(*a*) of the fingertip care implement 23A of FIGS. 3*a*-5. The diameter of the aperture 11 of the finger locking ring 8*a* can be smaller than the diameter of aperture 12 of the container body 7*a* in tins instance. Thus, this prevents the fingertip care sponge 1 from falling out of the container 7*a* because the finger locking ring 8*a* has its aperture 11 at a smaller diameter than the aperture 12 of the container 7*a*. The length of the fingertip inserted into the hollowed-out part 5 of the fingertip care sponge 1 can also be adjusted to the desired amount by setting the diameter of the aperture 11 of the finger locking ring 8*a* smaller than that of the aperture 12 of container body 7*a*. Only the portion of the fingertip with the nail can be inserted into hollowed-out part 5 of the fingertip care sponge 1 as it is equipped with the finger locking ring 8*a* when solvent is infused and used for fingertip care sponge 1 where, for example, nail enamel and gel nail is removed in this instance. Thus, the irritation on the skin of the fingertip when removing nail enamel and gel nail can be reduced by minimizing the contact area of solvent on fingertip skin.

Further, the aperture 11 materials of fingertip locking ring 8*a* is folded into the hollowed-out part side of container body 7*a*, forming a return part 10 for the fingertip care implement 23A of FIGS. 3*a*-5. The return part 10 allows for a configuration wherein the fingertip sponge 1 can be pressed into the container body and retained therein by the return part 10. Accordingly, the retention effect of the fingertip care sponge 1 in the container body 7*a* is improved in this instance.

Figure 4:
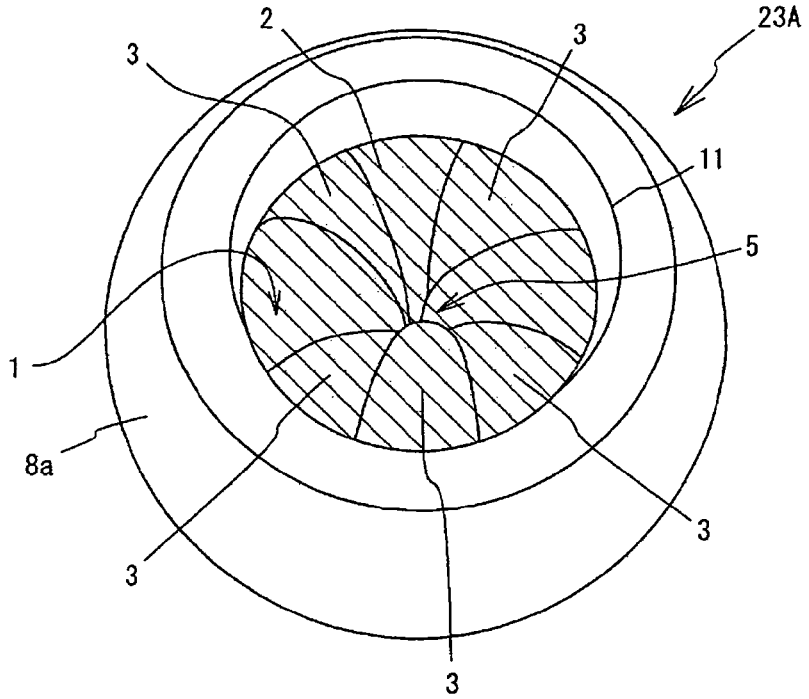
FIG. 4 is a view of the fingertip care implement viewed from the direction shown with the Q symbol in FIG. 3*a*.

FIG. 4 is a top view of the fingertip care implement viewed from the direction shown by the symbol Q in FIG. 3*a*. Identical symbols are also applied for the same part as for that described in FIGS. 1*a*-3*b*, and the description of these symbols' structure is omitted. The aesthetic appeal of the fingertip care implement 23A of FIGS. 3*a*-5 is improved because the return part 6 of fingertip care sponge 1 with a chrysanthemum crest-like shape is made visible from the aperture 11 of the finger locking ring 8*a* when this ring 8*a* is equipped to the fingertip care implement 23A shown in FIG. 4. Thus, the fingertip care implement 23A is also aesthetically appealing.

Figure 5:
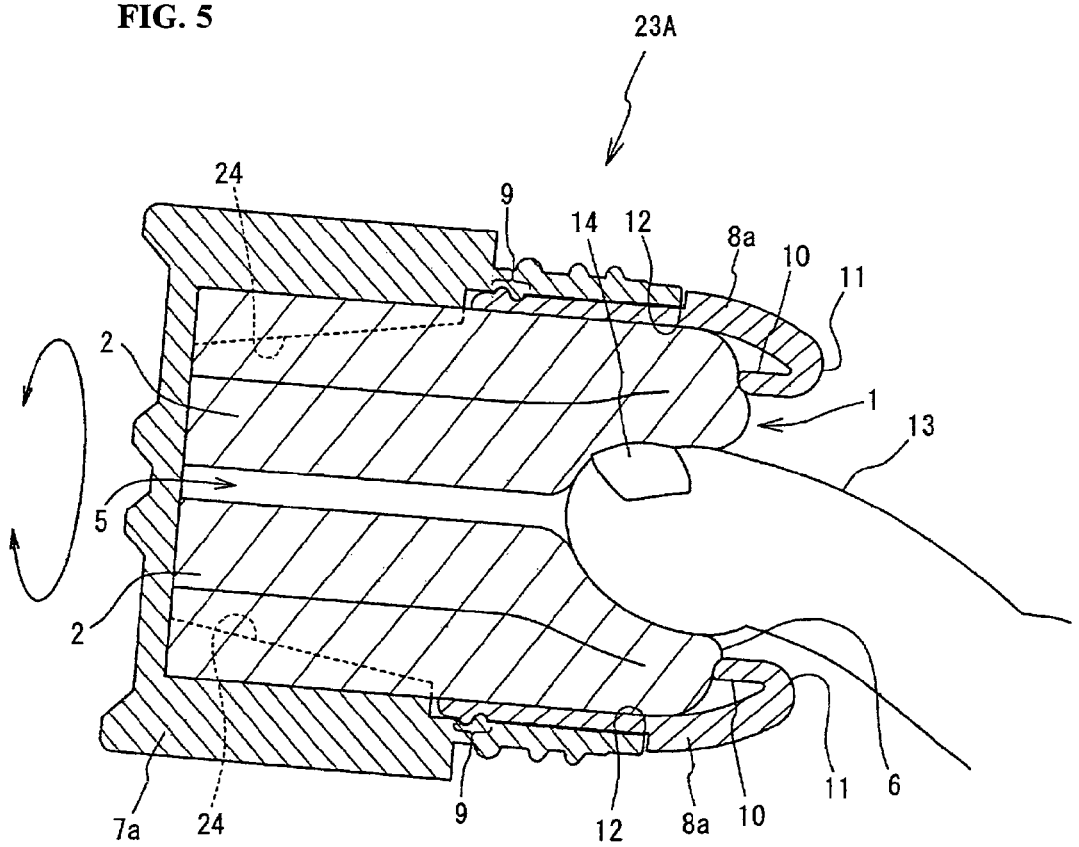
FIG. 5 is a cross-secitonal view of the second embodiment of the invention which shows the second embodiment of the invention in use.

Next, FIG. 5 shows the method for using the fingertip care implement 23A. FIG. 5 is a cross-sectional view showing the operation of the fingertip care implement 23A. Identical symbols are also applied for the same parts as those described in FIGS. 1*a*-4, and description of these symbols' structure is omitted. Further, a description citing the example where the finger locking ring 8*a* is equipped to the aperture 12 of container body 7*a* is shown in FIG. 5. A description of an example where a fingertip other than a person's big toe is used is also shown in FIG. 5. For how to use fingertip care implement 23A of FIGS. 3*a*-5, only the tip of the toe 13 is pressed into the hollowed-out part 5 from the folded part 6 of the aperture 11 of finger locking ring 8*a* in the fingertip care implement 23A. The container 7*a* is then rotated in this state while the sponge body 2 (fingertip cure sponge 1) is rotated on its center axis, or the tip of toe 13 is rotated on the center axis of sponge body 2, or both are rotated simultaneously. The entire circumference of the surface of the toe 13 is press forced more properly to the sponge body 2 and friction is created because the protrusions 3 of the sponge body 2 contact the toe's surface 13 using its elastic rebound force as the surface of toe 13 is pressed into the hollowed-out part 5 of the sponge body 2. The surface of the tip of toe 13 can be cleaned as a result.

More specifically, the present invention provides a cleaning and massage through the friction created on the surface of toe 13. In addition to the massage effect on the toe's surface 13, the implement of the present invention also massages or removes the cuticle on the tip of toe 13 and can demonstrate a polishing effect on the nail 14 when fingertip care sponge 1 contains materials with abrasiveness. A massage effect on the toe 13 and a polishing effect on the nail 14 are also demonstrated even when liquid, powder, cream or paste polisher is infused into the sponge 1. Every corner of the surface of the nail 14 can be polished completely as the protrusions 3 projecting into the hollowed-out part 5 of the sponge body 2 tracks closely to the curved surface of the nail 14 in this instance. The method to manipulate the container 7*a* also involves just rotating container 7*a* on its center axis, thereby making it extremely easy and convenient to provide a beauty aid that achieves superior results. Nail enamel can also be quickly and correctly removed from the nail 14 through the tracking effect on the nail 14 via the sponge body 2 when removal liquid is infused into the sponge body 2. Further, lame' and stones can be properly maintained to the groove 4 of the fingertip care sponge 1 even when lame' and stones for nail enamel decoration are used, thus it prevents lame' and stones from re-adhering when removing nail enamel. Nail enamel removal solvent can also be applied more efficiently to the sponge 1 such as only to the tip where nail 14 of toe 13 is when gel enamel removal solvent is infused and used to fingertip care sponge 1.

The tip of the toe 13 can also be treated effectively as the container 7*a* is rotated without any breakdowns even when the finger locking ring 8*a* itself is rotated with the outer circumference of the toe 13 contacting the aperture 11 of the finger locking ring 8*a*. The infiltration of the tip of the toe 13 to the back of the container 7*a* can be presented by setting the diameter of the aperture 11 of the finger locking ring 8*a* to the proper diameter where only the tip of toe 13 is inserted into the container 7*a*. Accordingly, only the tip of the toenail 14 can be treated.

The cap 15*a* covering the aperture 12 of the container 7*a* and the aperture 11 of the finger locking ring 8*a* can be set as shown in FIG. 3. The cap prevents dust, from getting inside the container 7*a* when fingertip care implement 23A is not in use. The cap 15*a* can also prevent the evaporation of the liquid and volatility of the solvent when infusing and using liquids and solvent as required in the fingertip care sponge 1 of the fingertip care implement 23A of FIGS. 3*a*-5. Further, the finger locking ring 8*a* can be rotated on the center axis of the container 7*a* at the aperture 13 of the container 7*a* while preventing the finger locking ring 8*a* from falling out of the container 7*a* by securing the finger locking ring 8*a* to the container 7*a* via mating 9 as shown in the cross section shown in FIG. 3*a*.

In addition, elastic materials (not shown) may also be interposed to the edge of the finger locking ring 8*a* and are preferably located opposite to the aperture 12 of the container 7*a* in the vertical cross section towards the center axis of the container 7*a* of fingertip care implement 23A. The elastic materials can prevent liquids from leaking from the container 7*a* because a watertight seal is provided to the contact part of the container 7*a* and the finger locking ring 8*a* in this instance. The elastic materials can also properly prevent dripping when the container 7*a* is tilted. Further, as cited in the example of care of the tip of a toe 13 in FIG. 5, the fingertip care implement 23A can be used without any breakdowns for fingertip care.

Third Embodiment of the Invention

Figure 6:
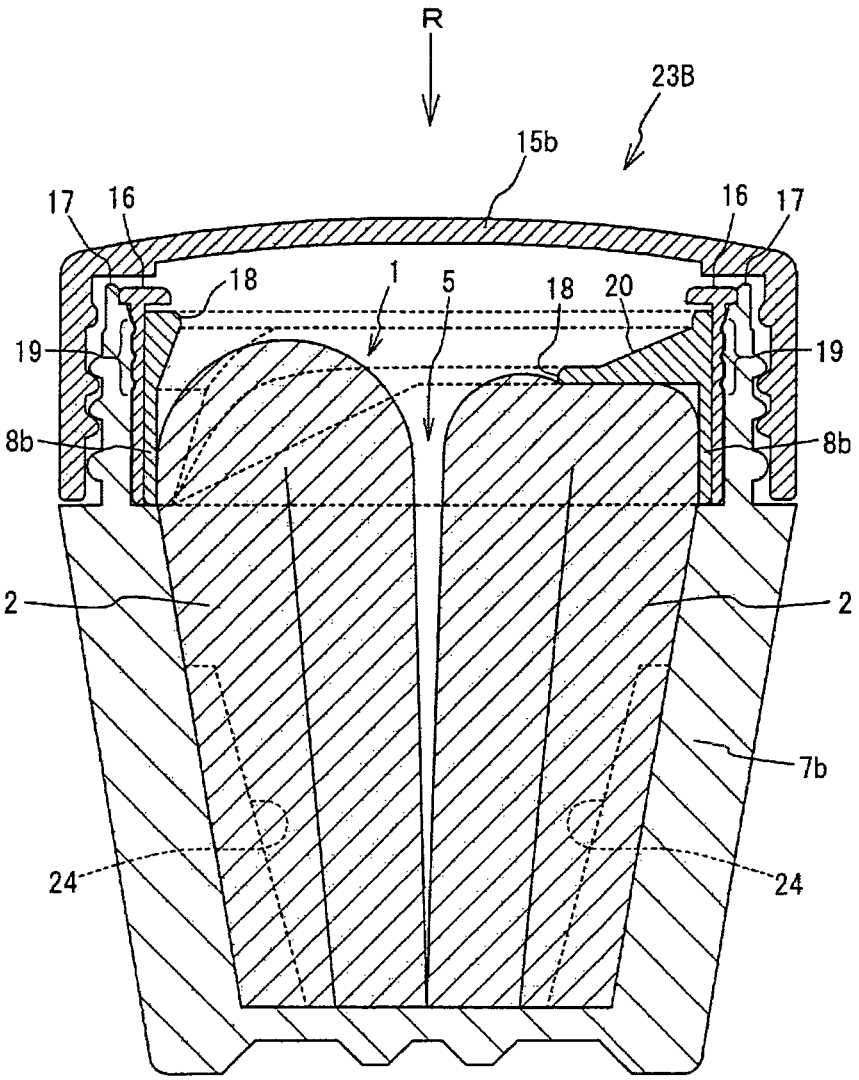
FIG. 6 is a cross-sectional view of the fingertip care implement of a third embodiment of the present invention.
Figure 7:
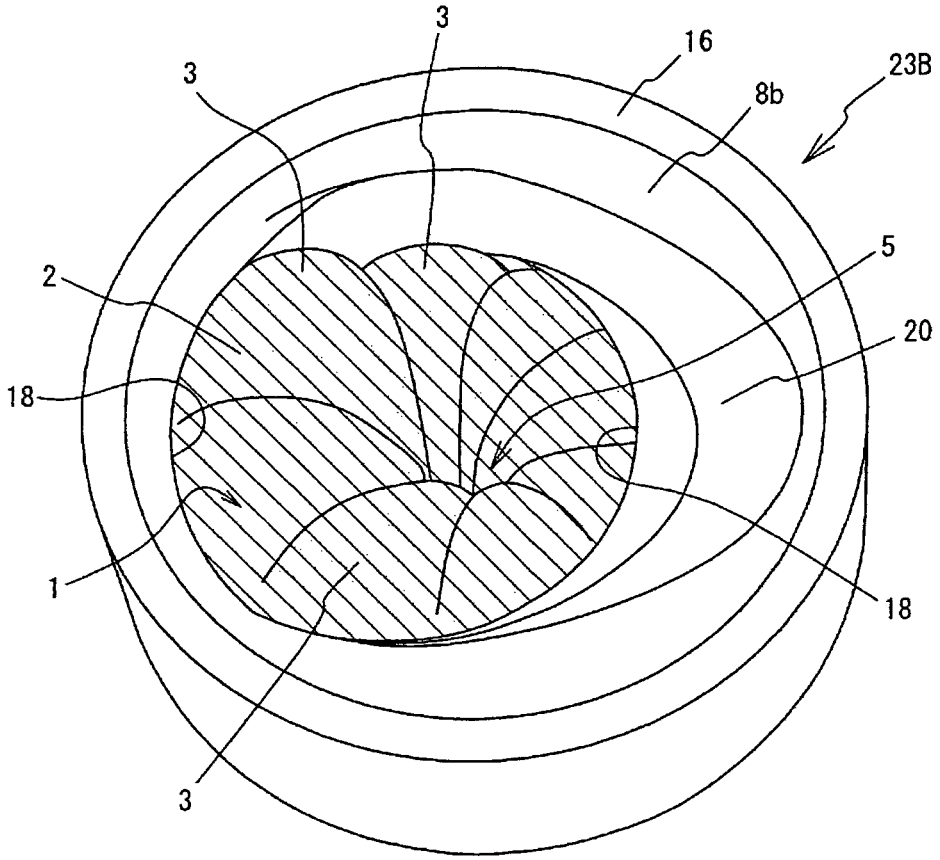
FIG. 7 is a view of the fingertip care implement from the direction shown with the R symbol in FIG. 6.
Figure 8:
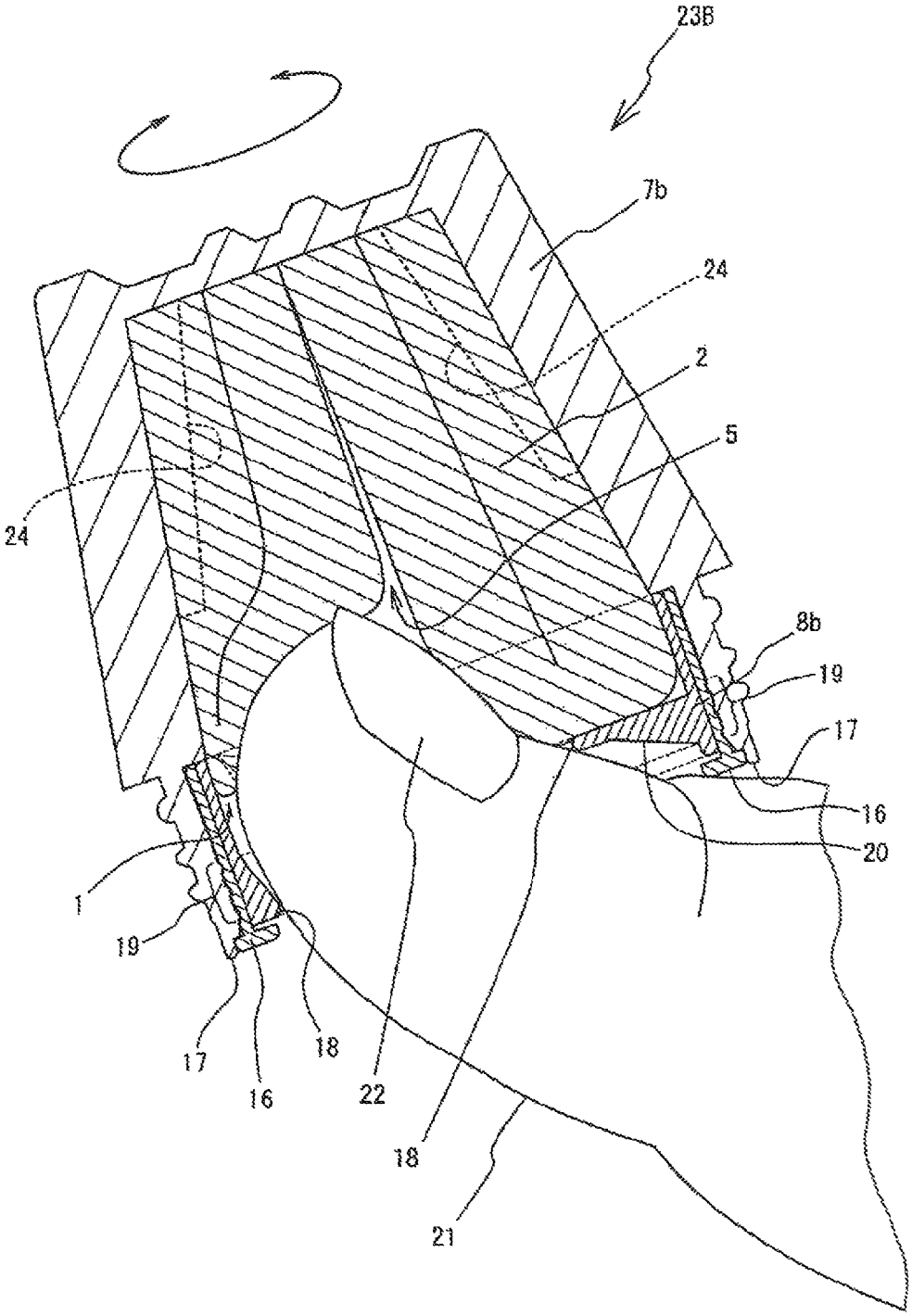
FIG. 8 is a cross-sectional view showing the operation of the third embodiment of the present invention.

FIG. 6 to FIG. 8 details a third embodiment of the fingertip care implement. The fingertip care implement of third embodiment of the present invention is suitable for thick finger care, particularly the thumb and big toe of a person. This embodiment differs from the second embodiment of the fingertip care implement in the structure of the finger locking ring and in the attachment method for the finger locking ring to the container. Further, details on techniques other than the finger locking ring structure and attachment method are the same as fingertip care implement 23A of the second embodiment of the invention. FIG. 6 is a cross-section of the third embodiment of the fingertip care implement. FIG. 7 is also a view of the fingertip care implement from the direction shown by the symbol R in FIG. 6. Identical symbols are also applied for the same parts as those described in FIG. 1*a* to FIG. 5, and a description of those symbols' structure is omitted. The action and the effect when finger locking ring 8*b* is not equipped for the fingertip care implement 23B of FIGS. 6-8 is the same as the action and effect when the finger locking ring 8*a* of fingertip care implement 23A of FIGS. 3*a*-5 is not equipped. Further, the container 7*b* of the fingertip care implement 23B of FIGS. 6-8 and the cap 15*b* have a similar support mechanism as the container 7*a* and cap 15*a* of the fingertip care implement 23A of FIGS. 3*a*-5.

The finger locking ring 8*b* is installed to enable rotation on the center axis of the container 7*b* via anchoring materials 16 to the inside of aperture 17 of container 7*b* when the finger locking ring 8*b* is equipped. Further, the anchoring materials 16 are short and cylindrically shaped and present near the edge located at the side of the aperture 17 of the container 7*b* is folded towards the center of the edge of the cylinder consisting of the anchoring materials 16, and has a structure where its aperture has a reduced diameter. While the anchoring materials 16 is mated so that it can rotate via mating 19 to the inner periphery adjacent to the aperture 17 of the container 7*b*, the finger locking ring 8*b* is positioned on the inner periphery side of the anchoring materials 16 and is locked to the folded part of the edge of anchoring materials 16. In this way, the finger locking ring maintains the ability to rotate on the center axis of the container 7*b* on the inner periphery of the anchoring materials 16. The finger locking ring 8*b* also forms a slope towards aperture 18 from its outer edge, and this slope is configured to function as a receptacle 20 when the fingertip is inserted into the aperture 18 as shown in FIGS. 6 and 7. The diameter of the aperture 18 formed to the finger locking ring 8*b* is configured to be smaller than the diameter of the aperture 17 of the container 7*b* for the fingertip care implement 23B, and the center of aperture 18 is eccentric towards the outer edge of finger locking ring 8*b*. This enables the sloped receptacle 20 to be formed adjacent to the aperture 18 of the finger locking ring 8*b*.

FIG. 8 is a cross-section showing the operation of the fingertip care implement 23B. Further, identical symbols are applied for the same parts as those described in FIGS. 1 to 7, and the description of these symbols structure is omitted. FIG. 8 cites an example where the Hallux, i.e. big toe, is treated. Toes other than the Hallux as well as the fingers can also be treated without any breakdowns. The tip of the toe 21 is inserted into the hollowed-out part 5 of the fingertip care sponge 1 which is housed in the hollowed part of the container 7*b*. The base of the toenail 22 is then locked to the receptacle 20. Here, the receptacle 20 is set to the state where the aperture 18 of the finger locking ring 8*b* is towards the vertical bottom side. Next, the container 7*b* is rotated in this state, the fingertip care sponge 1 housed in the container 7*b* is rotated on its center axis, or the toe 21 is rotated on the center axis of the container 7*b*, or both can be rotated simultaneously. While the rotational motion of the finger locking ring 8*b* and the anchoring materials 16 are hindered because the toe 21 comes into contact with the aperture 18 on the side where the receptacle 20 of the finger locking ring 8*b* is formed and the folded part of anchoring materials 16 adjacent to the aperture 18, the container 7*b* can rotate freely at the mating 19 of anchoring materials 16, thus the fingertip care sponge 1 rotates with container 7*b* and in its axial direction, creating friction and providing treatment for the surface of the tip of the toe.

Further, the ring-shaped elastic materials can be interposed to both sides of the parts opposing the finger locking ring 8*b* and anchoring materials 16, and those opposing the container 7*b* and anchoring materials 16 on the vertical cross-section towards the center axis of container 7*b* (not shown). A watertight seal can be provided for the joined part of the finger locking ring 8*b* and anchoring materials 16. This preferably prevents liquid from leaking when liquid is infused in the sponge body 2 of the fingertip care sponge 1. Further, although there are parts where the sponge body 2 of the fingertip care sponge 1 does not come in contact with the of the toenail 22 as shown in FIG. 8, the entire surface of the nail 22 can be treated completely by properly adjusting the insertion angle of the toe 21 into the container 7*a* and the tilt of the center axis of the container 7*b*. An aesthetic appeal is also provided by the fingertip care implement 23B because the folded part 6 of the fingertip care sponge 1 has a chrysanthemum crest-like appearance that is visible from the aperture 18 of the finger locking ring 8*b* as shown in FIG. 7.

Further, the vertical cross-section in the axial direction of the hollowed-out part of the container 7*b* can also have a reduced diameter as it approaches the bottom of the container 7*b* of the fingertip care implement 23B as shown in FIG. 6. The retention of liquids from the inside of container 7*c* invisible and thereby reduce visual unpleasantness when using fingertip care implement 23C as a result.

Pattern 2 and Pattern 3 have the same effect as Pattern 1 described earlier, and can also have the finger locking ring 8*c* and shielding materials 28 rested by pressing the shielding materials 28 into the inside of container 7*c* using the fingertip to be treated when the container 7*c* is rotated. Folded piece 28*a* is adhered closely to the surface of the skin on the fingertip to be treated (side without nail), and thus the folded piece 28 functions as a protective materials for the skin of the fingertip that needs no care in this instance. The planar shape of the folded piece 28*a* where the toes are actually placed as shown in FIG. 10 is, therefore, larger than the planar shape of the other folded piece 28*a*, and the part where the tip of toe 34 is placed is formed widely thus it can raise the protective effect on the tip of the toe being treated. Further, the example where slit 29 is formed to the shielding materials 28 is described in FIG. 10, but it can demonstrate a similar effect where a simple cut without a width (not shown) is formed to shielding materials 28 instead of the slit 29 shown in FIG. 10, and may also demonstrate a similar effect when both the slit 29 and a cut are both used. The desired material providing flexibility, durability and chemical resistance simultaneously can also be selected as the material for the shielding materials 28 and may be silicon, composite resin, etc.

FIGS. 10 and 11 show a representation of the method for using the fingertip care implement 23C. FIG. 11, in particular, is a horizontal view showing the conditions of use of the fingertip care implement 23C. Further, identical symbols are applied to the same part as that described in FIGS. 1 to 10, and the description of the symbols' structures are omitted. To treat the fingertip using the fingertip care implement 23C of FIGS. 9-11, the cap 15*c* is removed from the fingertip care implement 23C, and care as shown in FIG. 10, i.e., the toe 34 is retained in the finger locking ring 8*c* while the tip of toe 34 for each folded piece 28*a* is pressed into the container 7*c*. Next, the outer container that is integrated to the container 7*c* may be rotated on its center axis in this state (See the arrow in FIG. 11). This action allows the fingertip care sponge 1 retained using the anti-slip materials 24 in the hollowed-out part of the container 7*c* to be rotated according to the rotation of the container 7*c*. The surface of the tip of the toe 34 has friction created due to the sponge body 2, thus enabling treatment.

In describing this more specifically, a function and massage effect on the toe 34 is demonstrated using the sponge body 2 when the sponge body 2 housed in the container 7*c* does sponge body 2 at the bottom side of the container 7*b* is relatively higher than at the aperture 17 side of the container 7*b* when liquid is infused into the sponge body 2 because the sponge body 2 at the bottom part of the container 7*b* is not as compressed as the sponge body 2 at the aperture 17 side of the container 7*b*. The retention of liquids prevents the liquids from leaking from the fingertip care sponge 1 that is housed in the container 7*b* when the aperture 17 of the container 7*b* positioned towards the vertical bottom side. In addition, the outer shape of the container 7*b* also reduces the diameter as it moves towards the bottom, thus it can pinch near the bottom of the container 7*b* when the container 7*b* is manipulated. Thus, the fingertip care implement 23B can have improved operability. The cross-sectional shape of the hollowed-out part in the container 7*b* also has a reduced diameter as it moves towards the bottom of the container 7*b*. Further the height from the inner periphery of the container 7*b* of the anti-slip materials 24 projecting to the inner periphery of the container 7*b* rise as it moves towards the bottom of container 7*b*. The rise in height of the anti-slip materials 24 results in an even greater relative compression rate of the fingertip care sponge 1 that is housed in the container 7*b*, thereby raising the retention effect of liquids when using the sponge body 2.

The fingertip care implements in the second and third embodiments of the present invention 23A and 23B may be created as separate fingertip care implements and, though not depicted, may also be integrally configured facing the bottom of fingertip care implements 23A and 23B described in Examples 2 and 3 of the implementation. All fingers and toes can be treated with one (1) implement for the latter case as there is no threat of implements for thin fingers and those for thick fingers being dissipated (Fingertip care implement 23B of Example 2 of the implementation), and it is conveniently transportable.

Fourth Embodiment of the Invention

FIGS. 9 to 11 relate to the fourth embodiment of the present invention. In particular, FIGS. 9 and 10 describe the structure of the fingertip care implement according to this embodiment. FIG. 9 is a cross-sectional view of the fingertip care implement, and FIG. 10 is a partial perspective view showing only part of the fingertip care implement of this embodiment. Further, identical symbols are applied to the same parts as described in FIGS. 1 to 8, and the description of the symbols' structure and use is omitted. The fingertip care implement 23C of the fourth embodiment of the present invention is equipped with a finger locking ring 8*c* provided with shielding materials for the aperture 32 of the container 7*c* wherein at least a portion of the container interior is equipped with the anti-slip materials 24. The Cap 15*c* to cover the aperture 32 of the container 7*c* may also be installed to prevent infused sponge materials from spilling out or creating volatility when storing or transporting the container 7*c*. The materials infused into the sponge body 1 may be liquid, powder, cream or paste polisher, nail enamel removal liquid, or gel nail removal solvent. Further, elastic and flexible shielding materials 26 may be installed on parts that come into contact with the aperture 32 of the container 7*c*. One possible location for the elastic and shielding materials may be on the underside of the cap 15*c* as is shown in FIG. 9. This will help to prevent any leakage or dissipation of infused materials.

FIG. 10 provides details on the finger locking ring 8*c* and shielding materials 28 for the fingertip care implement 23C. The finger locking ring 8*c* is integrally installed with a mated structure 30 to form the aperture 32 of the container 7*c* as shown in FIGS. 9 and 10. This allows the diameter of the aperture 32 to have a smaller desired size than the diameter of the aperture of the container 7*c* while enabling the insertion of the fingertip care sponge 1 into the container 7*c* during production because the fingertip care implement 23C is equipped with the finger locking ring 8*c* separately from container 7*c*.

Fingertips for fingers to be treated can be inserted into hollowed-out part 5 of fingertip care sponge 1 in container 7*c* at a desired angle for fingertip care. After the fingertip is inserted, it may be retained in the finger locking ring 8*c* which enables very efficient fingertip care using the present invention's fingertip care implement 23C. The finger locking ring 8*c* also comes in direct contact with the finger being treated, so the desire is for its surface not to have an angulated shape but one with curves without corners. The finger locking ring 8*c* materials further possess flexibility; i.e., the finger locking ring is made with silicon or composite resin, etc. giving it a much softer and pleasant texture retaining the finger to be treated and it functions as a shielding material that prevents leakage of infused materials from the fingertip care sponge 1. The goal also is to equip the finger locking ring 8*c* materials with sufficient durability and chemically resistance when used with materials infused to the fingertip care sponge 1.

Further, while FIGS. 9 and 10 show an example where the finger locking ring 8*c* is anchored to the aperture of the container by being mated with the mating structure 30 on the container's aperture, the finger locking ring 8*c* may also be installed to allow for attachment and removal to and from the container 7*c*, and further may be equipped with a structure that rotates independently of the container 7*c*. The diameter of the aperture 32 can be set to the desired size according to the thickness of the finger to be treated by properly exchanging the finger locking ring 8*c* to be installed to the aperture of container 7*c* in the former case. Simply put, adjusting the width of the aperture 32 of the finger locking ring 8*c* can regulate the amount of insertion to prevent any undesired amount of the fingertip to be treated from being inserted. The finger locking ring 8*c* which retains the fingertip may also be rested even when the container 7*c* is rotated to treat the fingertip in the latter case, thus creating a pleasant feeling when using the fingertip care implement 23C (see fingertip care implement 23A and 23B of Example 2 and Example 3 described earlier).

Shielding materials 28 are also installed to cover the aperture 32 inside the finger locking ring 8*c* as shown in FIGS. 9 and 10. A plurality of slits 29 are formed in the shielding materials 28 to allow some of the shielding materials 28 to be returned to the hollowed-out part of container 7*c* as a tongue-shaped folded piece. The slits 29 are formed radially towards the outer edge from the middle of shielding materials 28 to thereby allow multiple comb-shaped folded pieces 28*a* to be formed parallel to the ring from along container 7*c* in this instance. For installing shielding materials 28 to the finger locking ring 8*c*, shielding made of flexible materials may also be installed integrally to the finger locking ring 8*c* anchored to the aperture of container 7*c* (Pattern 1), for example, and, while not depicted, shielding 28 made from flexible materials may also be installed integrally to the finger locking ring 8*c* to be rotated to the aperture of container 7*c* (Pattern 2). Or, while not depicted, shielding 28 made from flexible materials may also be installed to a separate ring that is installed integrally and that rotates independently inside the finger locking ring 8*c* that is anchored to the aperture of the container 7*c* (Pattern 3).

The shielding materials 28 have the effect of preventing materials infused to the fingertip care sponge 1 from leaking when the container 7*c* is titled while being hidden inside container 7*c* with Pattern 1 described above. It also has the effect of preventing loss due to volatility of the infused materials when the materials infused to fingertip care sponge 1 are volatile. Visible dirt on the fingertip care sponge 1 makes for a particularly unpleasant feeling when being used, where the fingertip care implement 23C of FIGS. 9 to 11 is used for nail enamel removal. Shielding materials 28 are installed to the finger locking ring 8*c* to make the not contain any drug solutions or polishing solvents. In addition to the friction action from the sponge body 2, a physical and chemical action from polishing solvent is applied which can remove any unnecessary cuticle material on the tip of the toe 34 and can polish the surface of nail 35 when liquid, powder, cream or paste polishing solvent is infused into sponge body 2. In addition to the friction action from the sponge body 2, nail enamel can also be removed smoothly from the nail 35 due to the dissolving action from the nail enamel removal liquid when the nail enamel removal liquid is infused to the sponge body 2. The fingertip care implement 23C of FIGS. 9-11 allows not only for the smooth removal of solids like decorative stones and lame' in the nail enamel where used, but also prevents their re-adhesion to the nail 35.

Moreover, contact of the nail enamel removal solvent with the skin of the fingertip can be minimized as gel nail removal solvent is applied to the nail 35 when this solvent, e.g. m. acetone, is infused to sponge body 2. It can also prevent volatility of the gel nail removal solvent.

The fingertip care implement 23C of FIGS. 9-11 can be used pleasantly without any breakdowns even where this is the only structure as described earlier. Rotating the container 7*c* by rotating the outer container 27 in the state shown in FIG. 11 causes the outer surface of the outer container 27 to come in contact with other fingers not being treated and creates friction between them with the potential to create unpleasantness. Based on these circumstances, the present invention includes a rotating ring 31 that rotates in the circumferential direction of the container 7*c*. The rotating ring 31 is installed separate from container 7*c* on the outer periphery of the aperture 32 side of the container 7*c* as shown in FIG. 9 and FIG. 10 so that no friction is created between the fingers not being treated and the container 7*c* when the container 7*c* is rotated.

Further, the container 7*c* is housed comfortably in the larger outer container 27. The outer container is also at a lower height than the container 7*c* to retain the rotating ring 31 on the aperture 32 side of the container 7*c* for the fingertip care implement 23C. The rotating ring 31 is preferably anchored integrally with the container 7*c* and the outer container 27. The edge of the aperture side of the outer container 27 is used as a stopper for the rotating ring 31. Further, the outer container 27 does not need to be equipped if the rotating ring 31 is retained so that it does not fall out from container 7*c*. A ridge 36 is also installed near the aperture of the container 7*c* and to the outer side of the container 7*c* as shown in FIGS. 9 and 10 to prevent the rotating ring 31 from falling out from the aperture 32 side with the fingertip care implement. The ridge 36 is used as a stopper for the rotating ring 31. The finger locking ring 8*c* may also be used as a stopper for the rotating ring 31 instead of the ridge 36 as shown in FIG. 9.

In addition, the fingertip care implement 23C may also have a configuration whereby a threaded part 25*a* is threaded onto the inner periphery of a cap body 25 a complimentary threaded part 27*a* is installed onto the outer periphery of the outer container 27. The mating threaded portions 25*a* and 27*a* removably secure the cap 25 to the container to enable attachment and removal to and from the outer container 27.

A person's fingertip or toe can be retained so that it is in the perfect state for care during fingertip/toe care by equipping the finger locking ring 8*c* to the fingertip care implement 23C as shown in FIGS. 9 and 10 described herein. The fingertip care implement also prevents friction between the outer container 27 and the other toe 34 as direct contact is not made with the rotating container 7*c* and the outer container 27 because the other toes 34 not being treated come in contact with rotating ring 31. The result is effective treatment for fingertips because of the fingertip care implement 23C, which also enables pleasant feeling. In addition, as cited in the example for toe care 34 using the fingertip care implement 23C, the present invention t can be used without any breakdowns for toe 34 as well as finger care.

INDUSTRIAL APPLICABILITY

This invention described earlier is related to a fingertip/toe care sponge and fingertip/toe care implement that has an aesthetic appeal and that can treat fingertips/toes with simple operations, quickly and correctly, and can be used in fields related to the cosmetic and beauty industry.

The invention claimed is:

1. A fingernail/toenail care implement comprising:

a housing having an end wall and at least one side wall extending from said end wall to form an opening opposite side end wall, said end wall and said side wall configured to form an interior surface and an open area;

a sponge comprising a sponge body extending from a first end to a second end, with an opening in said sponge body extending from said first end at least a portion of the distance towards said second end, and a plurality of protrusions circumferentially located on said body, said plurality of protrusions protruding outwardly and extending from said first end at least a portion of the way to said second end of said sponge, said protrusions being separated by a corresponding plurality of grooves between said protrusions;

wherein said first end of said sponge body is folded inwardly into said opening, towards said second end, to form a folded end, with at least a portion of said plurality of protrusions then oriented to protrude inwardly towards a center of said opening; and wherein said interior surface and said open area in said housing is configured to receive said folded sponge, with said folded end of said sponge positioned proximate to said housing opening, to permit a portion of the nail of the finger or toe of the user to be inserted therein towards the center of said sponge.

2. The fingernail/toenail care implement according to claim 1 wherein said sponge protrusions are curved.

3. The fingernail/toenail care implement according to claim 1 wherein said sponge protrusions are in the form of a circular arc.

4. The fingernail/toenail care implement according to claim 3 wherein said plurality of inwardly protruding protrusions of said sponge body cause friction on at least a portion of the nail surface of a finger or toe of a user inserted into said folded end of said sponge body.

5. The fingernail/toenail care implement according to claim 3 wherein said plurality of inwardly protruding protrusions of said sponge body create friction on the surface of the nail by contacting the surface of the nail, as said fingernail/toenail implement is rotated relative to the nail.

6. The fingernail/toenail care implement according to claim 1 wherein said housing further comprises a plurality of projections circumferentially spaced and extending from at least a portion of said interior surface of said side wall.

7. The fingernail/toenail care implement according to claim 6 wherein said housing projections have an outer surface comprised of an anti-slip material.

8. The fingernail/toenail care implement according to claim 7 wherein when said folded sponge is received into said open area of said housing, said housing projections mate with said sponge grooves, to cause said sponge body to rotate as the housing is rotated.

9. The fingernail/toenail care implement according to claim 6 further comprising a locking ring having a first portion configured to be secured to said housing proximate to said housing opening, and said locking ring having a second portion configured to retain the sponge body in said housing.

10. The fingernail/toenail care implement according to claim 9 further comprising a flexible shielding material configured to extend from said locking ring over at least a portion of said opening of said housing to shield at least a portion of the interior of said housing from the outside environment, said shielding material further having a plurality of slits to allow at least a portion of the nail of a finger or toe of the user to be inserted through said shielding material into the interior area of said housing.

11. A fingernail/toenail care device comprising:

a housing, said housing comprising an opening in an axial direction defining an interior surface forming a cavity therein, and a plurality of elongated protrusions protruding from said interior surface into said cavity, each of said elongated protrusions being spaced about said interior surface, and each being elongated in a direction substantially parallel to said axial direction;

a folded sponge housed in the cavity of the housing;

said sponge comprising a cylindrical shape having a first end and a second end, with a central opening therein, and a plurality of elongated protrusions protruding outwardly from said cylindrical shape, with each said sponge protrusion extending substantially parallel to the axis of said cylindrically-shaped sponge;

said folded sponge comprising said first end of said sponge being folded inwardly into said central opening, with a first portion of said elongated sponge protrusions being in proximity to said second end of said folded sponge, to protrude outwardly, and with a second portion of said elongated sponge protrusions being in proximity to said first end of said folded sponge to protrude inwardly; and wherein said folded sponge housed in the cavity of the housing comprises said outwardly protruding first portion of said elongated sponge protrusions being received within said spacing between said plurality of elongated protrusions on said interior surface of said housing.

12. The fingernail/toenail care device according to claim 11 further comprising an annular ring member having a first end and a second end, said first end of said ring member secured at said opening of said housing to rotate about an axis of the housing; said annular ring member comprising an annular return flange formed at said second end, a free end of said annular return flange configured to engage and positively retain said sponge within said housing cavity.

13. The fingernail/toenail care device according to claim 12 further comprising a cosmetic substance infused into said sponge.

14. The fingernail/toenail care device according to claim 13 further comprising a barrier member, said barrier member comprising a flexible material, said barrier member fixedly secured over said opening in said ring member to prevent loss of said cosmetic substance, said barrier member comprising a slit configured to provide access to said inwardly protruding second portion of said elongated sponge protrusions.

15. The fingernail/toenail care device according to claim 14 wherein a periphery of said slit forms a plurality of finger-like barrier projection members configured to flex to admit a finger therebetween.

16. The fingernail/toenail care device according to claim 15 wherein said plurality of finger-like barrier projection members comprises one large finger-like member extending to encompass a central portion of said barrier member, being surrounded by the rest of said plurality of finger-like members.

17. The fingernail/toenail care device according to claim 16 wherein said ring member is configured to be removably attached to said housing to be interchangeable, to permit interchanging of at least a first said locking ring having a first sized opening, and a second said locking ring having a second sized opening therein.

18. The fingernail/toenail care device according to claim 17 wherein said interior surface of said housing comprises a substantially cylindrical surface, and with each of said plurality of elongated protrusions protruding from said interior surface into said cavity being elongated in a direction substantially parallel to the axial direction of said cylindrical surface.

19. The fingernail/toenail care device according to claim 18 wherein said plurality of elongated protrusions on said cylindrically-shaped sponge comprise an anti-slip material.

20. The fingernail/toenail care device according to claim 19, wherein said central opening in said sponge comprises a cylindrical opening, said cylindrical opening being substantially concentric with respect to said cylinder of said sponge.

21. The fingernail/toenail care device according to claim 13 wherein said cosmetic substance infused into said sponge is a cosmetic substance from the group of cosmetic substances consisting of: a liquid, a powder, a cream, and a paste.

22. The fingernail/toenail care device according to claim 21, wherein said cosmetic liquid infused into said sponge is a cosmetic liquid from the group of cosmetic liquids consisting of: a polishing liquid; and a nail polish removal liquid.

* * * * *